United States Patent [19]

Goren et al.

[11] 4,232,625

[45] Nov. 11, 1980

[54] COLUMN STABILIZED SEMISUBMERGED DRILLING VESSEL

[75] Inventors: Yoram Goren, Los Angeles; Charles Springett, Irvine, both of Calif.

[73] Assignee: Sante Fe International Corporation, Orange, Calif.

[21] Appl. No.: 18,253

[22] Filed: Mar. 7, 1979

Related U.S. Application Data

[63] Continuation of Ser. No. 868,485, Jan. 11, 1978, abandoned, which is a continuation of Ser. No. 699,789, Jun. 25, 1976, abandoned, which is a continuation of Ser. No. 596,256, Jul. 16, 1975, abandoned.

[51] Int. Cl.[3] ..... B63B 35/44

[52] U.S. Cl. ..... 114/264; 114/61; 114/265

[58] Field of Search ..... 114/61, 256, 258, 259, 114/261, 264, 265

[56] References Cited

U.S. PATENT DOCUMENTS

| | | | |
|---|---|---|---|
| 2,375,286 | 5/1945 | Creed | 114/61 |
| 2,973,046 | 2/1961 | McLean et al. | 405/203 |
| 3,490,406 | 1/1970 | O'Reilly et al. | 114/265 |
| 3,616,773 | 11/1971 | Lloyd | 114/265 |
| 3,653,349 | 4/1972 | Brown | 114/265 |
| 3,780,685 | 12/1973 | Horton | 114/265 |

OTHER PUBLICATIONS

*Ocean Industry*, Jun. 1973, pp. 63–69, "Zephyr I, A New Rig Based on New Ideas".

*Primary Examiner*—Charles E. Frankfort

*Attorney, Agent, or Firm*—LeBlanc, Nolan, Shur & Nies

[57] ABSTRACT

The vessel comprises a pair of laterally spaced elongated hulls having a pair of upstanding columns at opposite ends thereof supporting a working platform and a drilling mast in spaced relation above the hulls. The hulls buoyantly support the vessel in a low draft in-transit floating condition with the hulls having freeboard. The hulls have ballast compartments to submerge the hulls and portions of stabilizing columns such that the waterline lies intermediate the height of the columns with the platform and drilling mast elevated above the waterline. The columns stabilize the vessel in the high draft condition and the number, cross-sectional area and configuration of the columns, the weight distribution of the vessel and the geometry of the submerged hulls and portions of the columns are such that the vessel obtains motion minimizing characteristics in the high draft condition. Various features include hydrostatic and geometric properties wherein the ratio of the righting moment about the pitch axis to the righting moment about the roll axis in high draft condition is within a range of 1.0 to 1.3 while the ratio of vessel length to width lies within a range of 1.2 to 1.5; a natural period in heave in a range of 16–18 seconds; and a heave response amplitude operator in a range of about 0.35 to 0.60 in the range of waves of 10–14 seconds.

14 Claims, 8 Drawing Figures

COLUMN STABILIZED SEMISUBMERGED DRILLING VESSEL

This is a continuation of application Ser. No. 868,485 filed Jan. 11, 1978 (abandoned) which is a continuation of application Ser. No. 699,789 filed June 25, 1976 (abandoned) which is a continuation of application Ser. No. 596,256 filed July 16, 1975 (abandoned).

BACKGROUND AND SUMMARY OF INVENTION

This invention relates to a semisubmersible column stabilized vessel and particularly to a twin hull column stabilized semisubmersible drilling vessel designed for low cost optimum construction and use.

A significant number of drilling operations have been conducted in offshore areas where a substantial body of water overlies the oil and/or gas field. For example, over 10,000 wells have been drilled offshore and oil and gas is presently piped to on-shore terminals from as far as 250 miles out to sea and in water depths up to 500 feet. Increasing worldwide demand for hydrocarbons has pushed the frontiers of offshore drilling activities further and further into deeper waters, more hostile seas, and drilling sites even greater distances from the shore. This has resulted in a trend over the past few years toward the construction of larger and more self-sustaining drilling vessels. Concommitantly, the offshore industry has incurred the high costs and long delivery times associated with the construction of such larger vessels. For example, construction costs have been growing in recent years at an average rate of 25% per year and the present costs of such large semisubmersible type drilling vessels typically are upwards of $40–$50 million and higher. The foregoing factors of increased cost, long delivery time, and increasing demand for immediate discovery and exploitation of oil and gas wells offshore and other factors have demonstrated the need for a vessel combining optimum performance, i.e. a vessel capable for performing drilling operations in most of the geographic areas in which hydrocarbons may be found offshore, with minimum construction costs and delivery time.

The present semisubmersible column stabilized drilling vessel constitutes an optimum vessel design for low cost construction with capability for conducting drilling operations in most geographic areas in the world. By imposing a few geographic constraints on the vessel's operation, the present vessel can be built with mass production techniques in minimum facility shipyards at low costs, and particularly at costs and construction time substantially reduced in comparison with the costs and construction time of present day large semisubmersible type vessels. More particularly, by excluding vessel operations in particularly harsh offshore areas of the world, a low cost optimum vessel is provided with efficient vessel configuration and layout to achieve optimum size for initial investment, minimum steel weight, effective motion reduction and stability, and motion characteristics equivalent to or better than much larger semisubmersible vessels.

Particularly, the present vessel design includes a pair of elongated lower hulls in transverse spaced side-by-side relation and supporting a platform in spaced relation above the hulls by a pair of columns adjacent the opposite ends of the hulls and longitudinally spaced trusses interconnecting the hulls, columns and platform.

The vessel may be ballasted to change its draft from a low draft in-transit floating condition with the hulls having freeboard to a high draft floating and drilling condition with the hulls and lower portions of the columns and trusses submerged below the mean waterline such that the latter lies along an intermediate portion of the column height. In the high draft condition, the columns provide righting moments about pitch and roll axes. Also the number, cross-sectional area, and configuration of the columns together with the weight distribution of the vessel and the geometry of the submerged hulls and portions of the columns are such that vessel motion is minimized in the high draft condition. The platform carries a centrally located drilling mast and ancillary drilling equipment and drilling operations are conducted with the drilling line extending downwardly from the platform between the hulls.

In optimizing the vessel design in accordance with the above, the vessel obtains certain characteristic features. For example, to provide adequate stability in the high draft condition, minimize vessel motion, minimize use of steel, and provide low cost construction and other features, the hydrostatic properties of the vessel should stand in relation to its geometric properties such that the ratio of the righting moment about the transverse pitch axis of the vessel to the righting moment about the longitudinal roll axis of the vessel when the vessel is in high draft semisubmerged operating condition lies within a range of 1.0 to 1.3 while the geometric ratio of the length of the vessel to its width should lie within a range of 1.2 to 1.5.

Further, the trusses, and the platform and drilling mast are aligned, interconnected, and interrelated to achieve high longitudinal and transverse structural strength and integrity with reduced steel weight. For example, high structural strength in the transverse direction is afforded by the alignment at each of the opposite ends of the forward and aft pairs of columns of a transverse bulkhead plate in each hull, the end shell plating of each columns, a continuous transverse bulkhead in the platform extending the width of the platform and the trusses which interconnect the hulls, platform and columns. Longitudinal structural strength is provided by the alignment of longitudinally extending shell plates in the platform with shell plates along the inner and outer sides of the columns and with longitudinally extending arches in each hull. Further, support columns directly interconnect the hulls and the platform drill floor and substructure. The majority of the structural support for the substructure including drilling mast and ancillary equipment is thus transmitted directly to the hulls. The foregoing structural arrangement minimizes the steel weight necessary to construct the vessel.

Still further, the present vessel design has a natural period in heave in a range of 16–18 seconds which is well outside the range of periods of normally occurring waves. More importantly, however, the present vessel obtains a heave response in terms of the ratio of heave amplitude to wave amplitude no greater than 0.60 for wave periods less than 14 seconds and within a range of 0.35 to 0.60 in the range of waves of 10–14 seconds. This heave response is at least as good as and in many instances better than the heave response of such larger and costlier semisubmersible vessels and this is achieved simultaneously with the achievement of the foregoing and other features of the present invention described herein whereby a low cost optimum semisubmersible drilling vessel is provided.

Accordingly, it is a primary object of the present invention to provide a novel and improved column stabilized semisubmersible drilling vessel of optimum size and performance.

It is another object of the present invention to provide a novel and improved column stabilized semisubmersible drilling vessel having high transverse and longitudinal structural strength with minimum steel weight.

It is still another object of the present invention to provide a novel and improved column stabilized semisubmersible drilling vessel including optimization of its geometric and hydrodynamic characterisitcs.

It is a further object of the present invention to provide a novel and improved column stabilized semisubmersible drilling vessel which, for a vessel of its size and configuration, has motion characteristics equivalent to or better than larger semisubmersible type vessels.

DESCRIPTION OF DRAWINGS

These and further objects and advantage of the present invention will become more apparent upon reference to the following specification, appended claims and drawings wherein:

DETAILED DESCRIPTION

Figure 1:
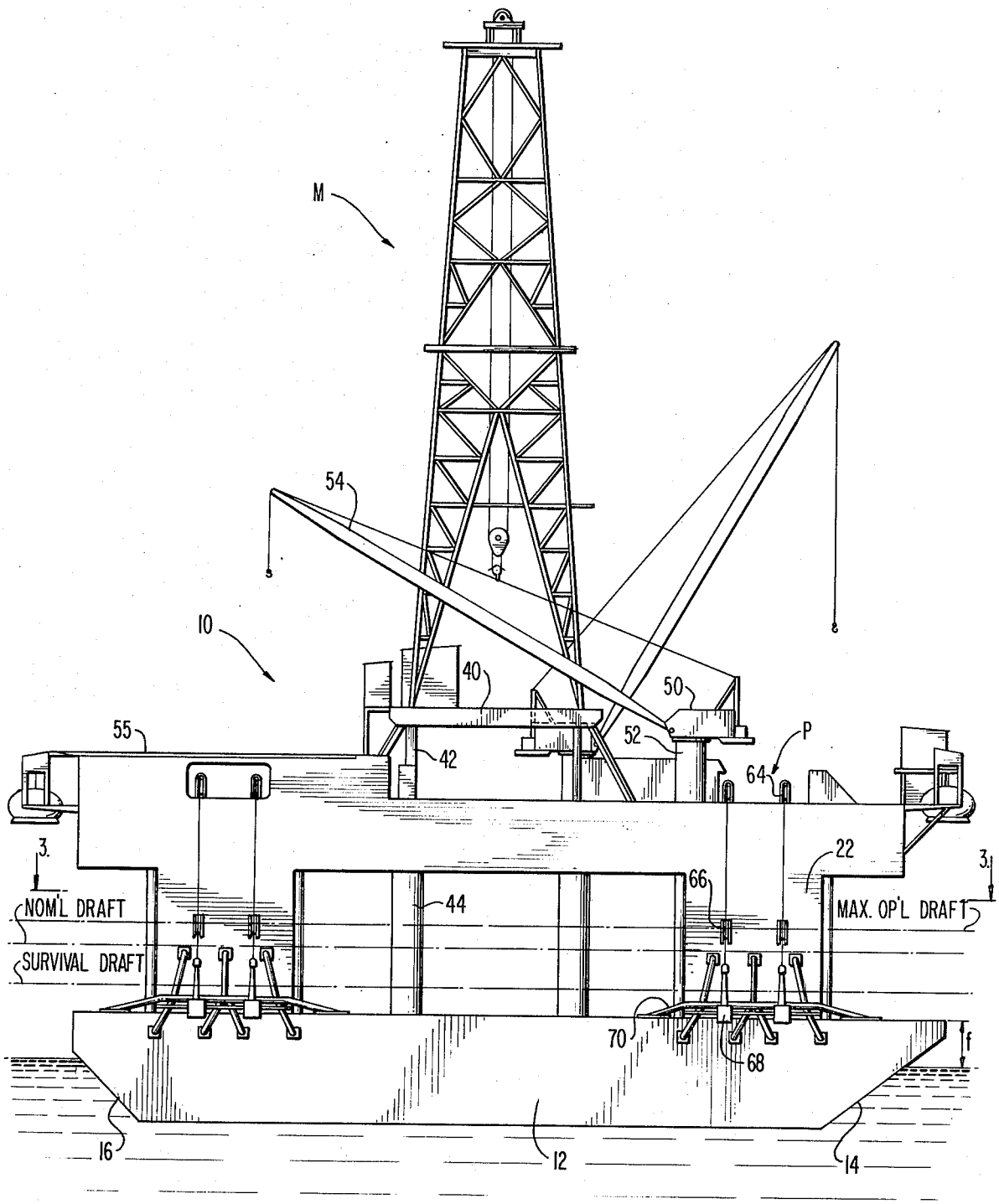
FIG. 1 is a side elevational view of a column stabilized semisubmersible drilling vessel constructed in accordance with the present invention.

Referring now to the drawings, particularly to FIG. 1, there is illustrated a column stabilized semisubmersible drilling vessel generally designated 10 comprising a pair of elongated hulls 12 in transverse spaced parallel relation one with the other and which hulls provide sufficient displacement to support vessel 10 in a floating condition with the hulls having freeboard indicated "f" in FIG. 1. Each hull has bow and stern rakes indicated 14 and 16, respectively thereby to minimize resistance to movement of the vessel through the water when towed in the low draft condition.

A platform generally designated P comprising upper and lower decks is supported a predetermined height above hulls 12 by support structure including a plurality of longitudinally spaced transversely extending truss formations generally designated 20 (FIGS. 2 and 3) and a plurality of columns 22. The truss formations 20 are disposed in longitudinally spaced pairs thereof with each pair lying in transverse alignment with the forward and aft extremities of the transversely adjacent pairs of columns. Particularly, each truss formation 20 includes a pair of upwardly and inwardly extending structural members 24 which are structurally connected at their upper ends to platform P and at their lower ends to the lower ends of columns 22 and the topsides of the hulls and particularly to the transversely extending structural members 26 which extend between the hulls adjacent their upper sides. The members 24 and 26 thus form a generally triangularly shaped truss arrangement which structurally reinforces the hulls, columns and platforms with the transversely extending members 26 particularly restraining the hulls against lateral movement relative to one another.

Figure 3:
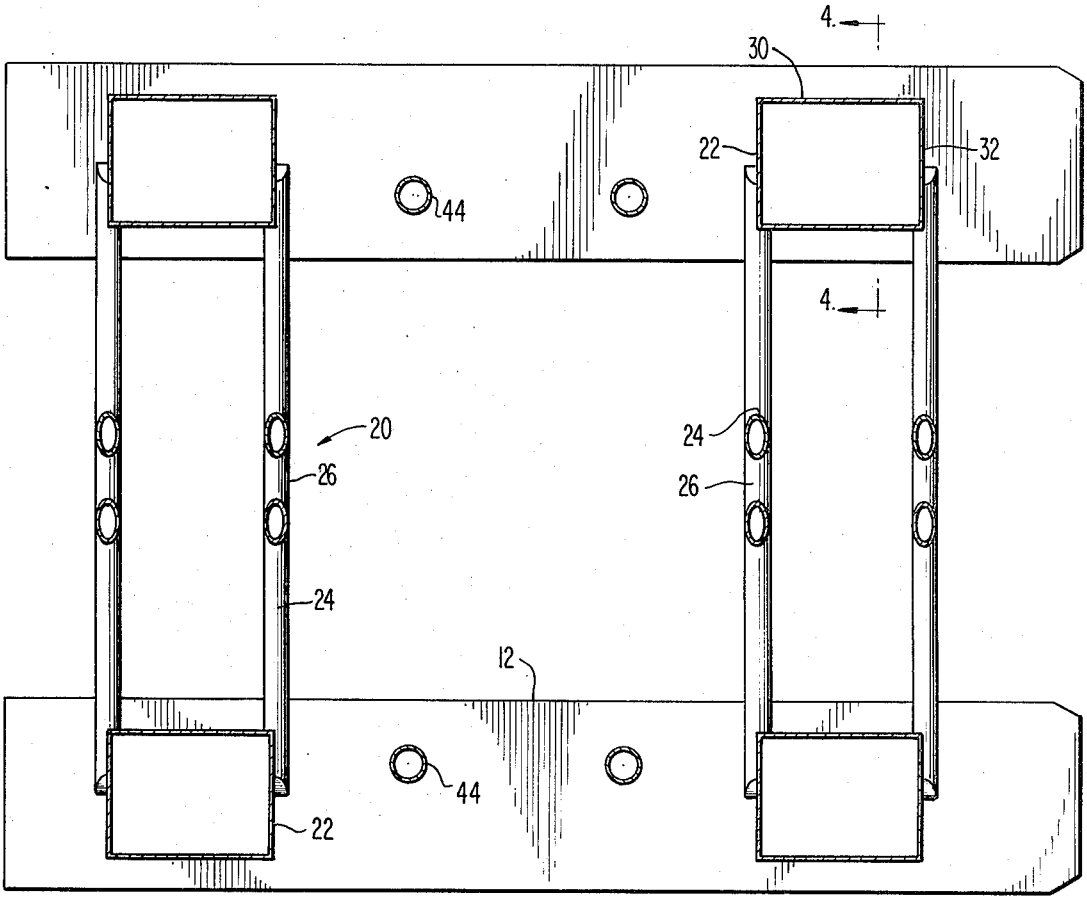
FIG. 3 is a horizontal cross-sectional view taken generally about on line 3—3 in FIG. 1.

The support structure also includes stabilizing columns 22 which extend upwardly from the upper surface of each hull to platform P an effective height which may be equal to and preferably greater than the maximum anticipated wave height, the vertical distance between the wave crest and trough. In the illustrated embodiment hereof, fore and aft columns 22 are located on each hull adjacent bow and stern portions of the hulls respectively. As best illustrated in FIG. 3, columns 22 are longer in the longitudinal direction than in the transverse direction and particularly have elongated vertical sides 30, and elongated forward and aft sides or shell plates 32. As illustrated in FIG. 3, the overall cross section of the columns 22 is thus rectangular for at least the intermediate portion of the columns between the platform and hulls. It will be appreciated, however, that the corners of the columns can be rounded and that the forward and aft ends of the columns may be semicircular in horizontal cross section. Also, such cross-sectional shape is maintained constant at least for that portion of the height of the column which lies between one-quarter of the column height from the underside of the platform and the topside of the hulls.

Figure 2:
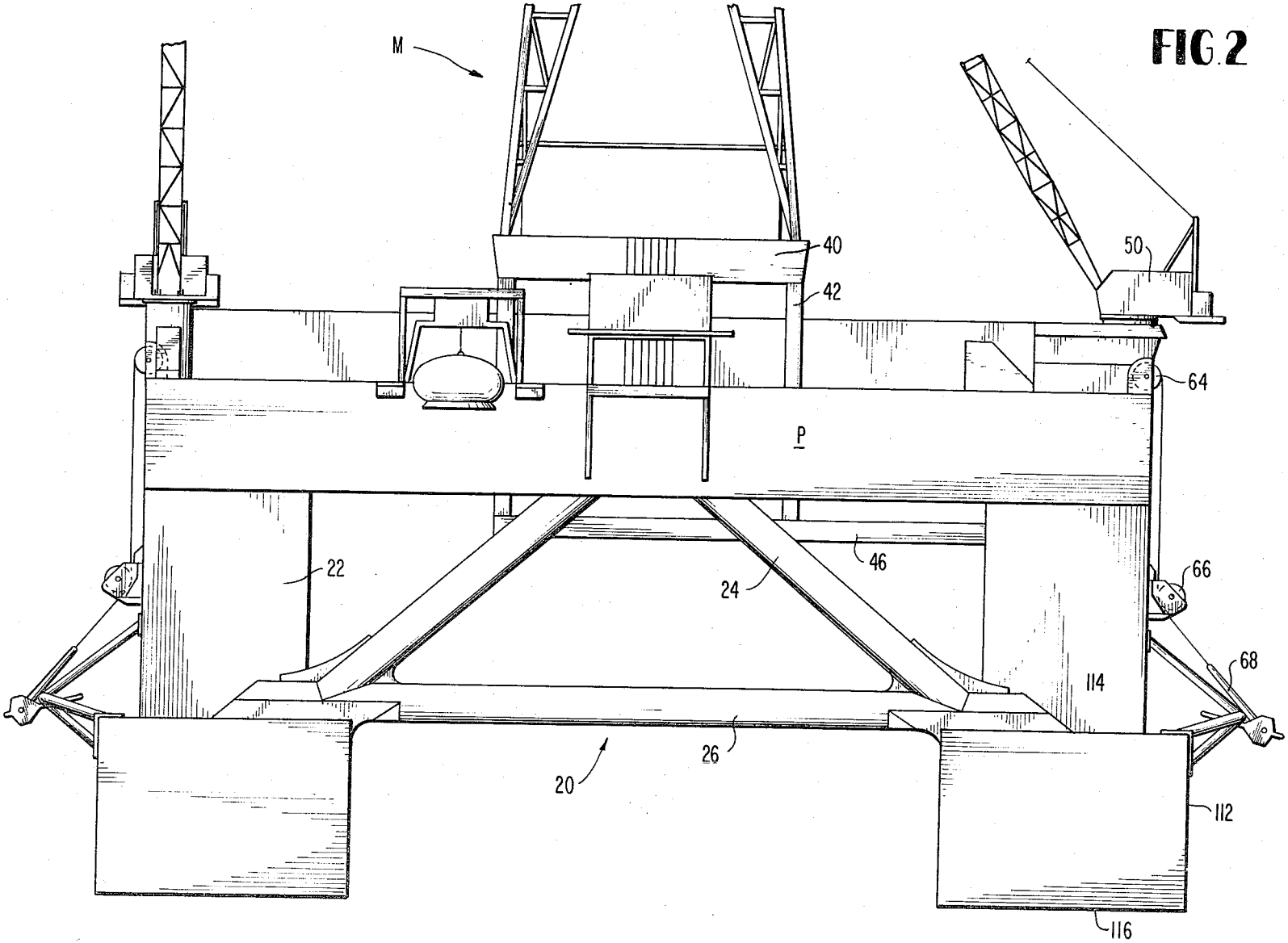
FIG. 2 is a bow elevational view of the vessel illustrated in FIG. 1.

Carried on the platform P is a drilling mast designated M mounted on a substructure 40 supported by uprights 42, the substructure 40 including a drilling floor which supports the lower end of the drilling mast as well as ancillary equipment such as the drawworks, air hoists, etc. Uprights 42 are connected at their lower ends to transverse structural girders and which girders are structurally supported by a pair of small diameter columns 44 connected at their lower ends to hulls 12. As more particularly noted hereinafter, the mast M and substructure 50 is substantially directly supported by the hulls 12 through the columns 44, girders, and uprights 42. Also, as illustrated in FIG. 2, a spider deck 46 extends below substructure 40 and below the lower deck of platform P for support of various equipment ancillary to the drilling operation such as blowout preventors, a diving bell, a compression chamber etc. Also supported on opposite sides of platform P are a pair of cranes 50 mounted on support columns 52. The support columns 52 are carried by the platform and each crane 50 has an elongated boom 54 and is rotatable such that the crane can perform lifting operations about the barge and to the side of the barge on which it is mounted. For example, cranes 50 may be employed to transfer drill pipe from supply boats to the storage areas aboard the platform. The aft end of the platform P is provided with a helideck 55 whereby personnel can be transferred to and from and supplies can be readily provided the vessel.

Figure 4:
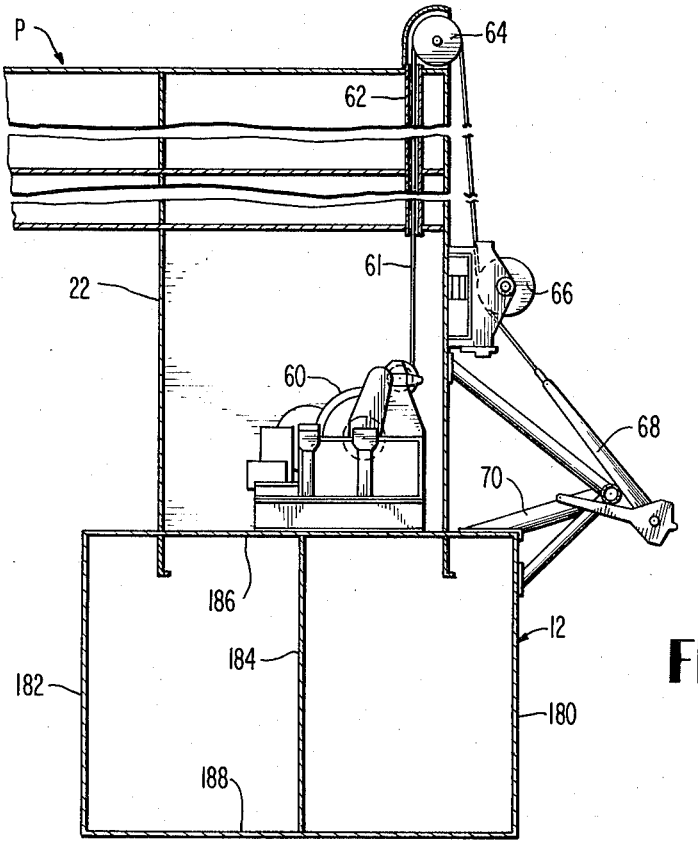
FIG. 4 is an enlarged cross-sectional view taken generally about on line 4—4 in FIG. 3.

Referring particularly to FIGS. 1 and 4, an eight-point mooring system is utilized on vessel 10. Particularly, each column houses a double-drum winch 60 over which pair of drums the anchor lines 61 are reeved. Each anchor line 61 extends from its drum through a cable trunk 62 over a pair of sheaves 64 carried on the upper deck of the platform and downwardly alongside and outboard of column 22 through a swivel fairleader 66 for connection with an anchor 68. Bolsters 70 are provided along the outboard sides of column 22 and hulls 12 and anchor 68 is racked with bolsters 70 when not in use.

Figure 5:
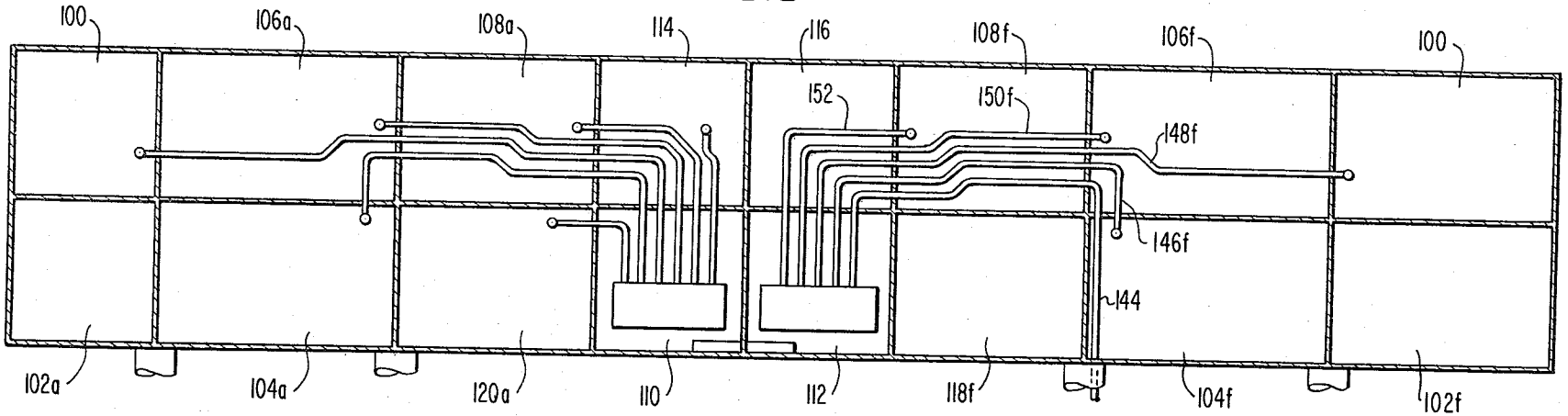
FIG. 5 is an enlarged schematic illustration of one of the hulls illustrating the ballast system therefor.

As illustrated in FIG. 5, hulls 12 are each divided into a plurality of compartments 100 including four ballast compartments 102, 104, 106, and 108 in each of the forward and aft portions or zones of each hull, the latter suffixes f and a being used to designate like compartments, as well as conduits and valves as described hereinafter, in the forward and aft portions of each hull respectively. Centrally of each hull are two pump rooms 110 and 112. On the outboard sides of the pump rooms are drill water and fresh water compartments 114 and 116, respectively. Forwardly of pump room 112 there is provided a fuel oil compartment **118*f* and directly aft of pump room 110 there is provided a second drill water compartment 120*a*. The pump room 110 services the compartments in the aft portion or zone of the hull while the pump room 112 services the compartments in the forward portion of the hull. From a review of FIG. 5, it will be apparent that the compartments are longitudinally and transversely spaced one from the other as indicated by the diagonal dashed lines in each compartment. It will also be appreciated from a review of FIG. 5 that the bow and stern ballast compartments 102*f* and 102*a* extend transversely the entire width of the hull while the remaining compartments extend transversely only one-half the width of the hulls. The remaining compartments are generally longer than wide with the exception of the drill water and fresh water compartments 114 and 116, respectively. Only the port hull and ballast system therefor is illustrated in FIG. 5. It will be understood, however, that the starboard hull is similarly arranged and ballasted but is of the opposite hand. Also, as will be apparent from the ensuing description, each hull is divided into forward and aft ballast zones each comprising the ballast compartments 102, 104, 106 and 108** and each compartment in each zone can be selectively and independently ballasted and deballasted whereby the hulls and lower portions of the columns may be submerged with the platform P remaining substantially level throughout the submergence thereof and whereby any attitude deviation of the vessel about heel and/or trim axes may be corrected during change of draft between low draft and high draft conditions and retention of the vessel in the high draft condition. It will be appreciated that the present system, as described hereinafter, also provides for ballast transfer between any one or more compartments in any one zone and any one or more compartments in any other zone.

To accomplish the foregoing, each pump room 110 and 112 is provided with a sea chest 130 and 132 to provide sea water inlets to conduits 132 and 136 which, in turn, communicate with fore and aft portions **138*f* and 138*a* of a main ballasting and deballasting conduit 140, conduit portions 138*f* and 138*a* being separated by a remote actuated valve 142. The fore and aft conduit portions form the opposite ends of the closed main ballasting and deballasting conduit or loop 140. With respect to the ballast system in the forward zone of each hull, conduit 138*f* communicates with each of conduits 146*f*, 148*f*, 150*f*, and 152*f* which, in turn, respectively communicate with the forward ballast compartments 104*f*, 102*f*, 106*f*, and 108*f* through a remote actuated valve 154*f* in each of conduits 146*f*, 148*f*, 150*f* and 152*f*. Conduit 144 also communicates with forward main conduit 138*f* and with the corresponding forward main conduit of the opposite hull and through a pair of remote actuated valves 156*f* for ballast transfer and crossover between hulls. A forward centrifugal pump 160*f* in pump room 112 communicates via conduit 162*f* between opposite ends of the forward main conduit 138*f*, valves 159*f* and 161*f* lying on opposite sides on pump 160 in conduit 162. Remote actuated valves 164*f* and 166*f* are also disposed in conduit 138*f* on opposite sides of the crossover and ballast conduits. A discharge conduit 170*f* communicates with the fore ballast conduit 138*f* on the pump side of valve 166*f* and terminates in an overboard discharge 172*f* which includes a remote actuated stop check valve 174*f***. The ballast system of the aft portion or zone of each hull has similar conduits, pump, and valves, and these are designated by like numerals as described above with reference to the forward zone ballast system but with a suffix a. Description of the aft ballast system is therefore not necessary, it being sufficient to note that the forward and aft ballast systems in each hull are independently and similarly operable such that the following description of the operation of the forward zone ballast system is likewise applicable to the aft zone ballast system.

To operate the ballast system and particularly to ballast the forward ballast compartments in one of the hulls, valves **137*f*, 161*f*, and 154*f* are opened while valves 164*f* and 174*f* are closed. In this manner, ballast water is pumped by pump 160*f* from the sea chest 132 through conduits 136, 162*f*, 138*f*, and 146*f*, 150*f* and 152*f* into the respective forward ballast compartments 104*f*, 102*f*, 106*f* and 108*f*. By closing one or more of the valves 154 in conduits 146*f*, 148*f*, 150*f* and 152*f*, those compartments 104*f*, 102*f*, 106*f*, and 108*f* can be selectively and independently ballasted from one another. To deballast the ballast compartments in the forward zone, valves 137 and 166*f* are closed and valves 164*f*, 159*f*, 161*f* and 174*f* are opened whereby the pump 160*f* suctions ballast conduits 146*f*, 148*f*, 150*f*, and 152*f* to withdraw ballast water from the associated compartments for delivery via conduits 138, 162*f*, and 170*f* overboard through the discharge 172*f*. It will be appreciated that one or more of the valves 154*f* can be maintained closed whereby one or more of the other ballast compartments in the forward zone can be deballasted as desired. The ballast compartments in the aft zone can similarly be selectively and independently ballasted and deballasted through operation of the corresponding valves and pump. Furthermore, ballast transfer between the compartments of one zone with the compartments of another zone can be accomplished by selected actuation of the valves 156, 164, 161, and 166**.

Figure 6:
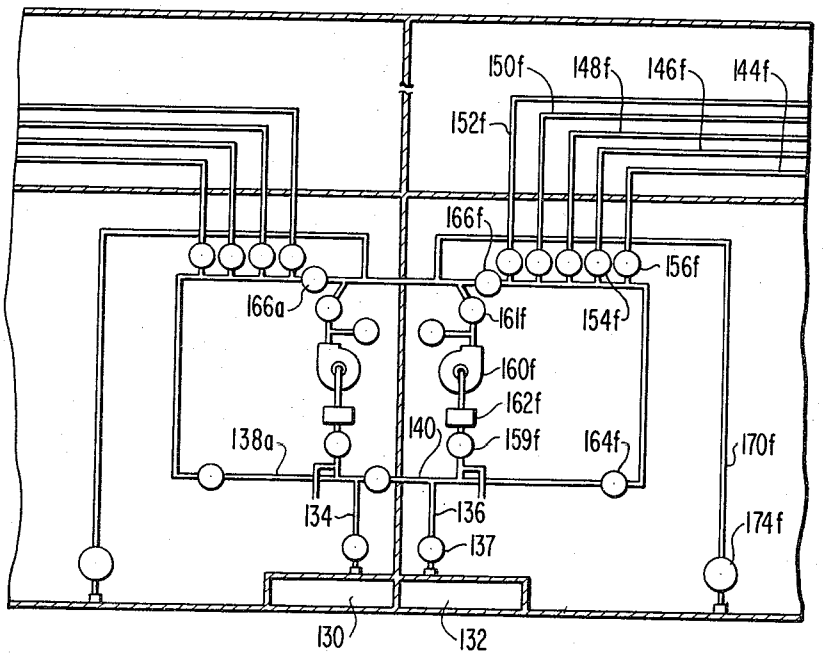
FIG. 6 is an enlarged schematic illustration of the pump rooms in one of the hulls and forming part of the ballast system.
Figure 7:
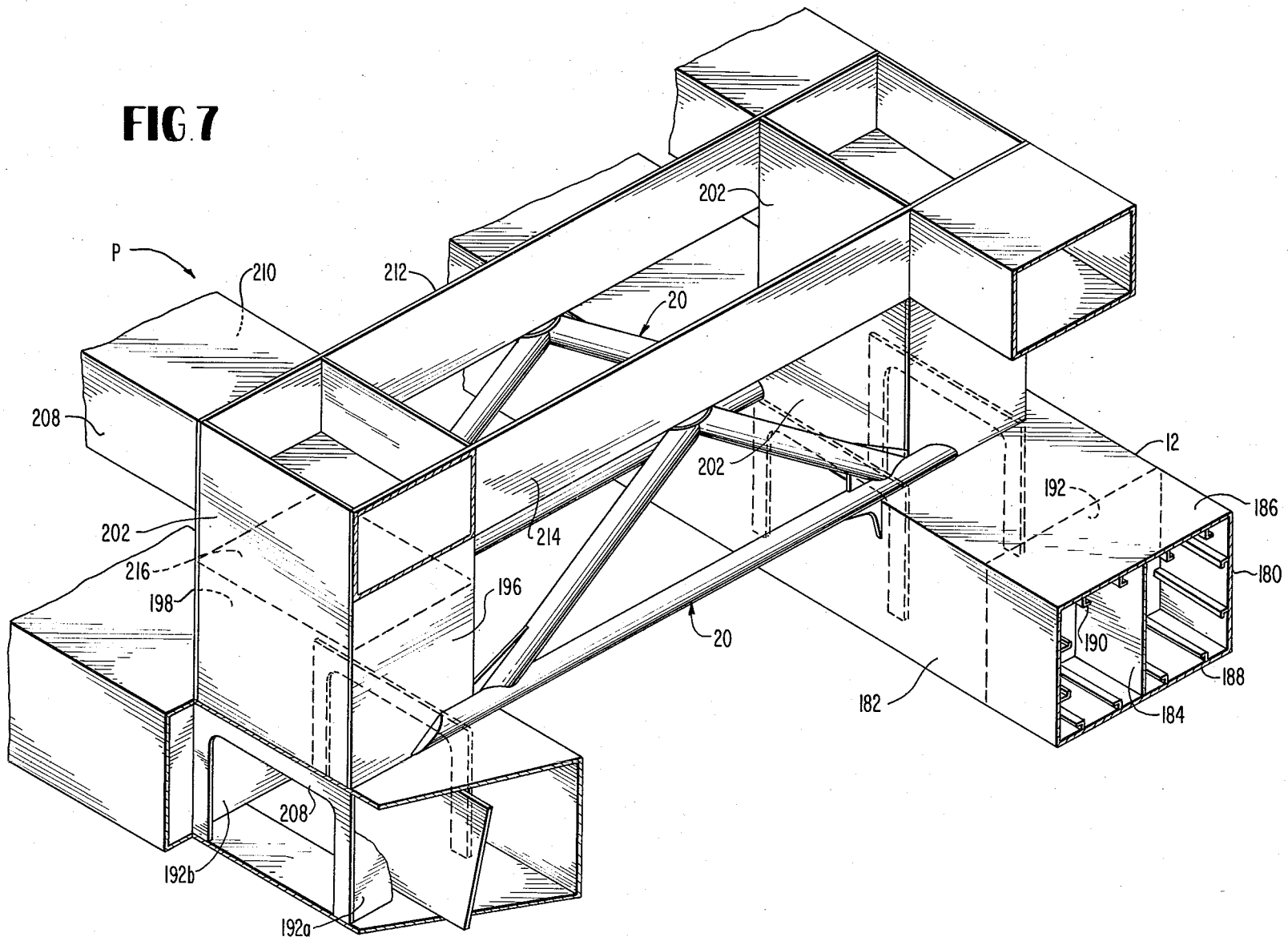
FIG. 7 is a fragmentary perspective view of certain structural characteristics of the present vessel with parts thereof broken out and in cross section.

Referring now to FIG. 7, there is diagrammatically illustrated certain structural characteristics of vessel 10 and particularly the alignment and interconnection and interrelation of structural elements forming the hulls, platform and trusses whereby improved longitudinal and transverse structural strength and integrity with reduced steel weight are achieved. Particularly, each hull 12 is comprised of longitudinally extending side shell plates 180 and 182, an intermediate hull plate 184 and top and bottom shell plates 186 and 188 respectively. These hull plates are reinforced by structural stiffening elements comprising a plurality of longitudinally extending parallel flanged plates 190 closely spaced one to the other along the inside faces of and structurally interconnected with the hull plates. In FIG. 6, the stiffeners 190 are exaggerated in size, only a few being shown, and it will be appreciated that a large number of these stiffeners closely spaced one to the other are formed along the inside surfaces of the top, bottom and side hull plates as well as along one of the surfaces of the intermediate plate 184. A plurality of longitudinally spaced, transversely extending, bulkheads 192 interconnect the side, top and bottom and intermediate hull plates and divide the hulls into the hull compartments schematically illustrated in FIG. 5. Consequently, the hull structure is essentially an elongated box-like structure with cross bracing at longitudinally spaced intervals. This type of structure provides hulls of high strength and structural integrity.

The columns are similarly formed of structural shell plate with reinforcing stiffeners extending vertically and in closely spaced relation one to the other along the inside surfaces of the shell plates and this together with a plurality of vertically spaced bulkheads constitute the structural elements of each column. For example, each column is comprised of fore and aft shell plates 196 and 198 respectively and inner and outer side shell plates 200 and 202 respectively. The forward and aft shell plates 196 and 198 lie in transverse alignment with transverse bulkheads 192*a* and 192*b* respectively in hulls 12. Since hulls 12 have a width greater than the width of the columns, the side shell plates 200 and 202 of columns 22 are aligned and interconnected with and supported by longitudinally extending arch girders 208 disposed between the longitudinally spaced transverse bulkheads 192*a* and 192*b*.

Platform P is similarly comprised of longitudinal and transversely extending plates with stiffeners to provide an upper unified platform structure of high strength and integrity. Particularly, platform P, along each of the opposite sides of the vessel, comprises two longitudinally extending plates 208 and 210 which extend substantially the length of the vessel and in vertical alignment with the vertically extending inner and outer side shell plates 202 of the longitudinally aligned columns. Also, a pair of transversely extending plates extends between the longitudinally extending plates 208 and 210 for substantially the full width of platform P in transverse alignment with the fore and aft shell plates 196 and 198, respectively of each of the forward and aft pair of columns. Furthermore, from a review of FIG. 7, it will be seen that transverse plates 212 and 214 lie in transverse alignment with the trusses 20 extending between the hulls, columns and platform. Thus, the vessel is transversely braced by the tubular members of the transverse trusses, the bulkheads in the hulls, transverse plates of the platform and the forward and aft shell plating of the columns. Longitudinally, the vessel is reinforced by the alignment of the arch girders in the hulls, with the inner and outer shell plating of the columns and the longitudinally extending plates 208 and 210 of the platform which extends along opposite sides of the vessel. This overall box-like structure together with the truss interconnection provides high strength and structural integrity with reduced steel weight. It will be appreciated that the longitudinal and transverse plates in the platform are provided with suitable openings for passageways and that openings are provided throughout the platform, hulls and columns whereby access to the various vessel spaces is obtained.

It will be further appreciated that the substructure support columns 44 terminate at their lower ends on transverse bulk heads 192 in the lower hulls 12. Thus, the weight of the mast and substructure is primarily transferred directly to the hulls through the support columns 44 although a smaller portion of such weight is transferred through the columns due to vessel stiffness.

It is a significant feature of the present invention that vessel 10 can be towed or self propelled, by means, not shown, between work sites at speeds on the order of 8–10 knots providing the present vessel with high mobility in transit. To this end, the hulls 12 have a displacement such that the vessel can be supported in a low draft hull supported condition with the hulls having freeboard f. In such in-transit condition, the truss formations and stabilizing columns are above the waterline and accordingly do not present frontal area to the water to offer resistance to passage therethrough. Also, the bow rake facilities movement of the vessel through the water in the low draft condition. When vessel 10 reaches the work or drilling site, the eight-point anchoring system is deployed to maintain the vessel over the target hole on the sea bottom. Also, hulls 12 are ballasted as aforedescribed preferably by simultaneously ballasting the ballast compartments in each hull to submerge the hulls 12 and lower portions of the columns below the waterline. Vessel 10 is preferably submerged to the extent that columns 22 are submerged slightly less than approximately half their effective height thereby locating the mean waterline slightly below the median of the columns. The displacement of the submerged portions of the columns 22 and the residual displacement of hulls 12 maintain the vessel in a floating high draft condition and in this manner the maximum anticipated wave is prevented from acting against hulls 12 and platform P and acts only on columns 22 and the trusses and other support structure whereby the adverse effect of wave action on the vessel is reduced. It will also be appreciated that in the high draft semisubmerged condition, the cross-sectional area and configuration of the columns, the weight distribution of the vessel and the geometry of the submerged hulls and portions of the columns are such that the vessel obtains minimum motion. To alter the vessel response particularly in heave to wind and wave action, the vessel can be ballasted or deballasted from its operational draft to either increase or decrease the extent of the submergence of the hulls and lower portions of the columns whereby the natural period of the vessel is altered and preferably changed to lie further away from the period of the existent sea conditions.

When in the high draft operating condition, the columns provide waterplane areas at locations relative to the pitch and roll axes of the vessel such that the righting moment about the transverse pitch axis of the vessel is preferably slightly greater than the righting moment about the longitudinal roll axis of the vessel. Particularly, the columns have cross-sectional areas and are located such that the ratio of the righting moment about the transverse pitch axis of the vessel to the righting moment about the longitudinal roll axis of the vessel when in high draft condition lies within a range of 1.0 to 1.3 A slightly greater righting moment about the pitch axis is desirable in view of the greater free surface effect in the longitudinal direction of the liquid in the hull compartments which generally have a longer dimension in the longitudinal direction than in the transverse direction. Further, as noted hereinafter, the present vessel is preferably greater in length than in width and has a geometric length to width ratio lying within a range of 1.2 to 1.5 for the aforedescribed ratio of righting moments.

Figure 8:
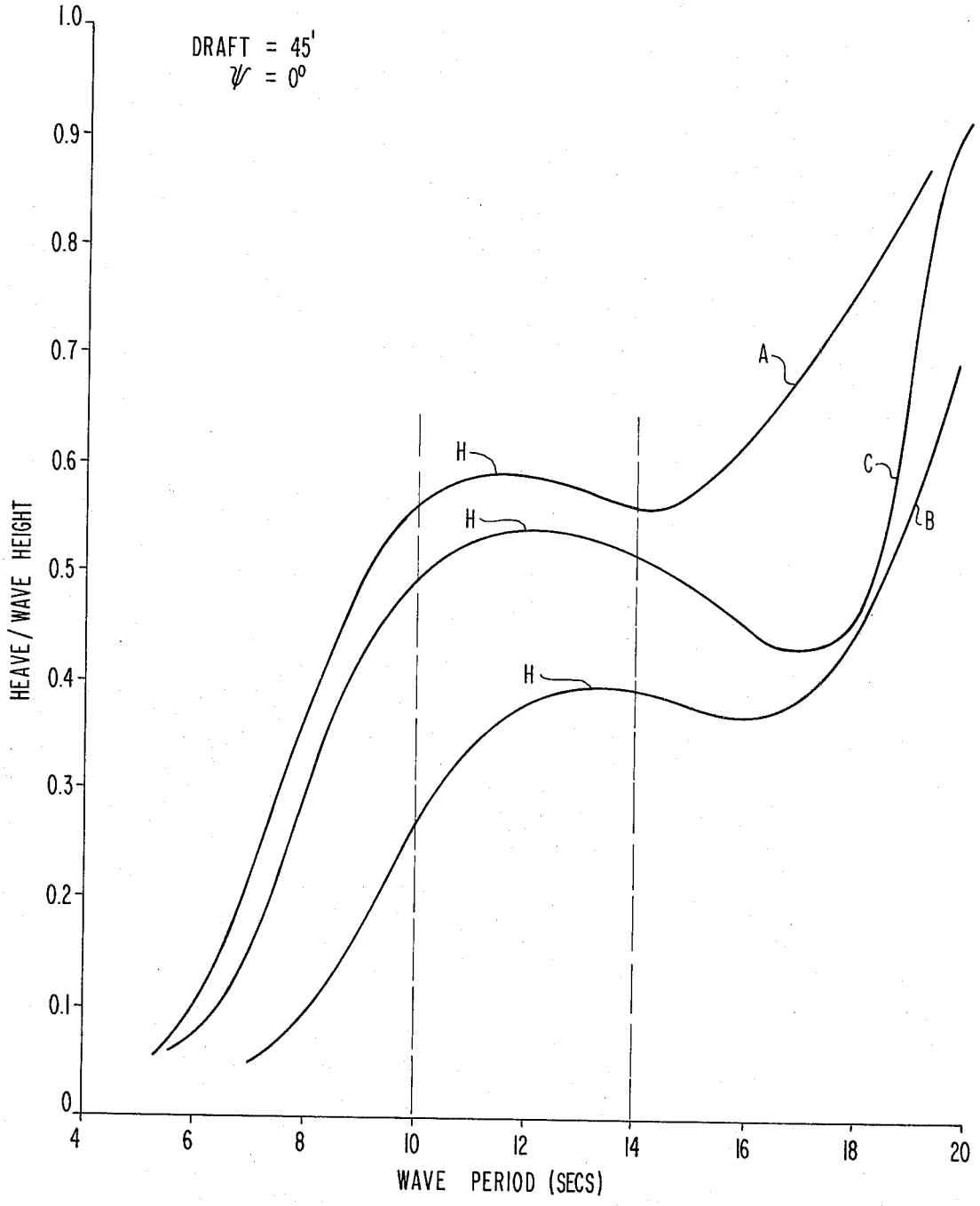
FIG. 8 is a graph illustrating heave response characteristics of the present vessel in a plot of the heave response amplitude operator along the ordinate versus the wave period in seconds along the abscissa.

FIG. 8 discloses heave response curves for the present vessel at an operating draft of 45 feet and in head seas indicated in FIG. 8 by the notation $\psi=0°$. In FIG. 8, the operating wave period is plotted along the abscissa and the heave response amplitude operator, i.e. the ratio of the vessel's heave amplitude to the wave amplitude, is plotted along the ordinate. To achieve the foregoing described advantageous vessel characteristics, i.e. optimum size and performance for low initial investment, a vessel constructed in accordance with the present invention should have a natural period within a range of 16–18 seconds, the present vessel having a natural period in heave of 17.6 seconds. From a review of FIG. 8, it will be seen that over the range of wave periods below the natural period of the vessel, a vessel constructed in accordance with the present invention has a heave response amplitude operator no greater than about 0.60. For a practical vessel of this type, the vessel's heave response amplitude operator will lie within a range of about 0.35 to about 0.60 for waves in the 10–14 second region.

A natural vessel period in heave of this magnitude, i.e. between 16–18 seconds, is achieved by proper selection of the cross-sectional area of the columns, the vessel displacement, and underwater shape or geometry of the hulls and columns in the high draft condition of the vessel. For example, the cross sectional shape of the hulls is important particularly in the high draft condition of the vessel in relation to improving the heave response of the vessel and preferably each hull has top and bottom substantially planar horizontally disposed surfaces extending perpendicular to a vertical plane through the longitudinal centerline of the vessel with the transverse horizontal dimension of each hull being greater than its vertical dimension to provide increased mass resistance to movement of the hulls through water in a vertical direction when the vessel lies in the high draft column stabilized semisubmerged condition. Such surfaces should extend substantially over the entire length of the hulls consistent with proper bow and stern designs. The generally rectangular cross-sectional shape of the hulls disclosed herein provides such mass damping effects. In connection with such improved heave response characteristics, the hulls of the present invention should have a ratio of hull width to hull height within a range of 2:1 to 1:1 and preferably about 1:5:1. The total cross-sectional area of the columns at the waterline in the high draft condition is 3000 square feet and for a vessel having a displacement in the range of 11,000 to 15,000 tons should be within the range of 2500 to 3500 square feet.

A heave response amplitude operator in the range of 0.35 to 0.60 for 10–14 second waves and particularly a heave response amplitude operator less than 0.60 for wave periods less than the present vessel's natural period of 17.6 seconds is obtained by proper selection of the foregoing factors, i.e. column cross-sectional area, vessel displacement, and underwater shape of the hulls and columns in the vessel's high draft condition, and additionally the transverse spacing of the hulls one from the other. The transverse spacing of the hulls has a very significant effect on the height of the first hump (designated H) of the heave response curves illustrated in FIG. 8 and generally the greater the spacing between the hulls the lower the first hump. Thus, to achieve as low a first hump as possible, the hulls should be spaced as wide apart as possible consistent with other considerations and, in the present vessel, the overall beam of the vessel at the hulls should stand in relation to the space between the hulls within a range of 1.5:1 to 2:1. Stated differently, a vessel constructed in accordance with the present invention should have a ratio of the combined hull width to the transverse spacing between the hulls within a range of 0.7 to 1.4 and this range preferably should be between 0.80 to 1. In a vessel constructed in accordance with the dimensions given below the actual ratio of combined hull width to the transverse spacing between the hulls is 0.86 well within the preferred range.

Referring again to FIG. 8, heave response curves designated A and B are plotted and the heave response amplitude operator for a practical vessel constructed in accordance with the present invention lies within the envelope defined by the curves A and B for the given wave periods. Such limits define a vessel having the described characteristics, i.e. a vessel economical in construction and of sufficient size and capacity for operations in most geographic regions yet of sufficient size to perform its intended purpose. Model tests have indicated a heave response curve designated C in FIG. 8 for a vessel of this type and which curve C lies within envelope curves A and B.

Further referring to FIG. 8 as noted above, FIG. 8 shows heave Response Amplitude Operator (RAO) curves (A, B and C) of a type commonly used in the involved art to show the ratio of heave (double amplitude) to wave height plotted on the ordinate against the wave period in seconds plotted on the abscissa. The units on the abscissa are sometimes merely referred to, for convenience, as "period"; the amplitude ratio on the ordinate is often referred to as the "RAO". (For such a heave response curve (RAO) and its significance see FIG. 6 of paper entitled "Development of the Project Mohole Drilling Platform" by Alan C. McClure published by SNAME in early 1966 (hereinafter called "Society Mohole Paper").) Referring again to FIG. 8 and curve A therein, the first portion of the curve at the left in FIG. 8 extending to approximately 10 seconds wave period may properly be referred to as the "low wave period section" of the heave response curve (RAO). The next portion of curve A designated at H in FIG. 8 is frequently referred to by naval architects as the "first hump" of the heave response curve (RAO); see discussion above. The third upwardly extending right-hand portion of such heave response curve A continues rightwardly from the "first hump" in an upward direction; this is called "third section " of the heave response curve (RAO) and includes the natural period.

In a preferred embodiment of the present invention, the vessel has an overall length of 205 feet and a width of 156 feet providing a preferred length to width ratio of about 1.3. Each hull has an overall width of 36 feet leaving an inside spacing between hulls of 84 feet. The hulls have an overall height of 25 feet. The columns have a height of 33 feet with an overall longitudinal dimension of 32 feet and a transverse dimension of 24 feet. The structural support columns are 7 feet in diameter. The stabilizing columns each provide a cross-sectional area of 768 square feet. The centroid of the forward columns lies 46 feet aft of the forward extremity of the hull while the centroid of the aft columns lies 35 feet forward of the aft extremity of the hull. The centroid of the columns lies coincident with centerline of the hulls on which they are mounted. The vessel has a light-ship displacement of 6500 tons and an operating displacement in the high draft condition of 12,900 tons. The vessel's GM in the maximum loaded high draft condition is 4.0 feet and should be maintained within a range of 4 to 10 feet. The normal operating draft of the vessel is 40 feet from the base line or bottom surface of the hulls while the maximum operational draft is 45 feet. A watertight bulkhead or flat 216 (FIG. 7) extends across each column 22 at the thirty foot elevation thus enabling operation of the vessel at a maximum draft of 45 feet. This flat also improves the structural strength and integrity of the vessel as described previously in connection with FIG. 6. Survival draft is 30 feet and in the high draft condition the mean waterline is preferably maintained in operating condition a distance along the columns at an elevation at least 0.25 of the column height above the top surface of the hulls.

Claim Definition

The below defined terms are used in the claims for convenience and shall be construed according to the following definitions:

(a) The "low period section" of the vessel's heave response curve (RAO) is defined as described and explained hereinabove (b) The "first hump " section of the heave response curve (RAO) is defined as described and explained hereinabove;

(c) The "third section" of the heave response curve (RAO) is defined as described and explained hereinabove;

(d) "T" represents wave period in seconds, plotted on the graph abscissa;

(e) "RAO" or Response Amplitude Operator shows the ratio of heave (double amplitude) to wave height, and is plotted on the graph ordinate.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A column stabilized semisubmersible vessel consisting of a pair of elongated hulls disposed in substantiallyparallel spaced side-by-side relation with each of said hulls spaced from and lying on an opposite side of the longitudinal centerline of said vessel, said vessel further comprising:

a working platform spaced above said hulls a predetermined height;

means for supporting said platform in fixed spaced relation above said hulls, including four stabilizing columns connecting said hulls with said platform;

the ratio of the length of said vessel along its longitudinal centerline to the width of said vessel along its transverse centerline being greater than 1.0;

one pair only of said stabilizing columns being connected with each of said hulls on opposite sides of the vessel roll axis, with one column of each said pair being located near respective opposite ends of each hull on opposite sides of the pitch axis of the vessel;

means for ballasting said vessel including ballast compartments in said hulls, to alter the vessel's draft between a low draft hull-supported floating condition with the hulls having freeboard and a high draft semisubmerged column stabilized floating and operating condition with mean water-line located intermediate the height of said columns;

said columns being of cross-sectional areas and location so as to provide a ratio of righting moment about the vessel's transverse pitch axis to righting moment about the vessel's longitudinal roll axis within a range of 1.0 to 1.3 when said vessel is in high draft semisubmerged operating condition;

each of said hulls for at least substantially the major portion of its length being of substantially oblong cross-section and having top and bottom substantially parallel substantially planar surfaces, with breadth of each hull cross-section in direction of the vessel's transverse axis being greater than vertical height of each hull section;

the width of the vessel at the hulls in relation to the transverse spacing between the hulls being within a range of 1.5:1 to 2:1;

a plurality of longitudinally spaced structural means reinforcing the structural relationship of the hulls, platform and columns; and said vessel comprising means including said columns of predetermined cross-sectional area, said transverse spacing of the hulls one from the other, vessel displacement, and geometry of the submerged portions of the vessel in high draft column stabilized semisubmerged operating condition being such as to provide a vessel heave response curve having a "low wave period section", a "first hump", and a "third section" with an "RAO" in relation to wave period "T" according to the following mathematical relationships:

(i) the RAO value of the curve's "first hump" is not greater than 0.6 for values of T between about 10 to 14 seconds;

(ii) the "third section" of the curve has a natural period value of between about 16 to 18 seconds.

2. A vessel according to claim 1, wherein said last-mentioned means also are such as to provide said vessel heave response curve also having a "low wave period section" with an "RAO" in relation to wave period "T" according to the following mathematical relationship:

the RAO value of the curve's "low wave period section" is less than 0.6 for values of T between 0 and about 10 seconds.

3. A vessel according to claim 1 wherein the ratio of the length of said vessel along its longitudinal centerline to the width of said vessel along its transverse centerline lies within the range of 1.2 to 1.5.

4. A vessel according to claim 1, wherein each said stabilizing column has a substantially rectangular and substantially constant cross-section over at least that portion of the column lying between one-quarter of the column height from the underside of the platform and from the topside of the hulls.

5. A vessel according to claim 1, further comprising a drilling mast carried by said platform, said drilling mast being located substantially centrally of said vessel substantially at the intersection of the longitudinal and transverse centerlines of said vessel.

6. A vessel according to claim 1 further comprising a drilling mast on said platform located substantially centrally of said vessel, and a plurality of elements upstanding from said hulls for supporting said drilling mast so that at least a substantial portion of the weight of said drilling mast is transferred directly to said hulls.

7. A vessel according to claim 1, wherein each of said hulls is substantially rectangular in cross-section over substantially the major portion of its length.

8. A vessel according to claim 1 wherein said structural reinforcing means include transversely extending members structurally interconnecting uppermost portions of said hulls.

9. A vessel according to claim 1 wherein said structural reinforcing means include a plurality of trusses each located longitudinally of the vessel at a position adjacent one of said pairs of columns.

10. A vessel according to claim 1, wherein each said hull has a longitudinally extending bulkhead dividing such hull into transversely spaced compartments, with a plurality of transversely extending bulkheads dividing such hull into longitudinally spaced compartments.

11. A column stabilized semisubmersible vessel consisting of a pair of elongated hulls disposed in substantially parallel spaced side-by-side relation with each of said hulls spaced from and lying on an opposite side of the longitudinal centerline of said vessel, said vessel further comprising:

a working platform spaced above said hulls a predetermined height;

means for supporting said platform in fixed spaced relation above said hulls, including four stabilizing columns connecting said hulls with said platform;

one pair only of said stabilizing columns being connected with each of said hulls on opposite sides of the vessel roll axis, with one column of each said pair being located near respective opposite ends of each hull on opposite sides of the pitch axis of the vessel;

each of said stabilizing column having a substantially rectangular and substantially constant cross-section over the effective column height extending between the topside of the hulls and the underside of the platform; each rectangular cross-section column including two pairs of substantially vertical substantially parallel substantially planar sides, with one pair of sides extending longitudinally of the vessel substantially perpendicular to the vessel's pitch axis;

said working platform including a plurality of substantially vertical plates extending transversely of the vessel substantially perpendicular to the vessel's roll axis, with one of said plates being substantially in alignment with each of said rectangular column's sides extending transversely of the vessel;

said working platform including a plurality of substantially vertical plates extending longitudinally of the vessel substantially perpendicular to the vessel's pitch axis, with one of said plates being substantially in alignment with each of said rectangular column's sides extending longitudinally of the vessel;

the ratio of the length of said vessel along its longitudinal centerline to the width of said vessel along its transverse centerline being within a range of 1.2 to 1.5;

means for ballasting said vessel, including ballast compartments in said hulls, to alter the vessel's draft between a low draft hull-supported floating condition with the hulls having freeboard and a high draft semisubmerged column stabilized floating and operating condition with mean water-line located intermediate the height of said columns;

said columns being of predetermined cross-sectional areas and location so as to provide a ratio of righting moment about the vessel's transverse pitch axis to righting moment about the vessel's longitudinal roll axis within a range of 1.0 to 1.3 when said vessel is in high draft semisubmerged operating condition;

each of said hulls for at least substantially the major portion of its length being of substantially rectangular cross-section and consisting of a pair of substantially equal substantially horizontal substantially parallel substantially planar surfaces and a pair of substantially vertical substantially parallel substantially planar surfaces, with breadth of each hull cross-section in horizontal direction being greater than vertical height of each hull section;

each said hull including a plurality of substantially vertical bulkheads extending transversely of the vessel substantially perpendicular to the vessel's roll axis, with one of said bulkheads being substantially in alignment with each of said rectangular column's sides extending transversely of the vessel;

the width of the vessel at the hulls in relation to the transverse spacing between said rectangular hulls being within a range of 1.5:1 to 2:1;

a plurality of longitudinally spaced structural means reinforcing the structural relationship of the hulls, platform and columns; said structural reinforcing means including a plurality of trusses, each truss located longitudinally of the vessel at a position adjacent one of said rectangular columns's sides extending transversely of the vessel; and each truss including transversely extending members structurally interconnecting uppermost portions of said hulls;

said vessel comprising means including said columns of predetermined cross-sectional area, said transverse spacing of the hulls one from the other, vessel displacement, and geometry of the submerged portions of the vessel in high draft column stabilized semisubmerged operating condition being such as to provide a vessel response curve having a "low wave period section", a "first hump", and a "third section" with an "RAO" in relation to wave period "T" according to the following mathematical relationships:

(i) the RAO value of the curve's "first hump" is not greater than 0.6 for values of T between about 10 to 14 seconds;

(ii) the "third section" of the curve has a natural period value of between about 16 to 18 seconds.

12. A vessel according to claim 11 wherein each said hull includes a plurality of substantially vertical girders extending longitudinally of the vessel substantially perpendicular to the vessel's pitch axis, with one of said girders being substantially in alignment with each of said rectangular column's sides extending longitudinally of the vessel.

13. A vessel according to claim 11, wherein said last-mentioned means also are such as to provide said vessel heave response curve also having a "low wave period section" with an "RAO" in relation to wave period "T" according to the following mathemactical relationship: the RAO value of the curve's "low wave period section" is less than 0.6 for values of T between 0 and about 10 seconds.

14. A vessel according to claim 11 further comprising a drilling mast on said platform located substantially centrally of said vessel, and a plurality of elements upstanding from said hulls for supporting said drilling mast so that at least a substantial portion of the weight of said drilling mast is transferred directly to said hulls.

* * * * *

UNITED STATES PATENT AND TRADEMARK OFFICE

CERTIFICATE OF CORRECTION

PATENT NO. : 4,232,625

DATED : November 11, 1980

INVENTOR(S) : Yoram Goren; Charles Springett

It is certified that error appears in the above-identified patent and that said Letters Patent are hereby corrected as shown below:

Column 9, line 53, "1:5:1" should read --1.5:1--.

Column 11, line 55, "tiallyparallel" should read --tially parallel-- (two words).

Column 14, line 49, insert the word --heave-- between "vessel response".

Signed and Sealed this

*Twenty-third* Day of *February 1982*

[SEAL]

*Attest:*

GERALD J. MOSSINGHOFF

*Attesting Officer*

*Commissioner of Patents and Trademarks*